United States Patent [19]

Kehoe

[11] Patent Number: 4,687,227

[45] Date of Patent: Aug. 18, 1987

[54] FILE CLIPS

[76] Inventor: Michael J. Kehoe, 2620 Third Ave. S., #3, Minneapolis, Minn. 55408

[21] Appl. No.: 680,280

[22] Filed: Dec. 10, 1984

[51] Int. Cl.[4] ..... B42D 17/00; G09E 1/10; B42F 17/00; B65D 3/00

[52] U.S. Cl. ..... 281/45; 40/158 R; 229/1.5 R; 312/184

[58] Field of Search ..... 281/45; 40/156, 158 R, 40/359, 360, 388, 391, 394; 312/183, 184, 185; 229/1.5 R; 24/3 E, 3 F, 7, 10 R, 455

[56] References Cited

U.S. PATENT DOCUMENTS

| | | | |
|---|---|---|---|
| 1,741,350 | 12/1929 | Swift . | |
| 1,845,327 | 2/1932 | Paget | 40/158 R |
| 2,062,436 | 12/1936 | Yawman | 40/359 |
| 2,223,642 | 12/1940 | Shaw | 229/1.5 R |
| 2,329,007 | 9/1943 | Simon et al. | 40/158 R |
| 2,606,507 | 9/1971 | Williams, Jr. | 312/184 |
| 2,805,502 | 9/1957 | Smith et al. | 40/391 |
| 3,125,460 | 3/1964 | Rose . | |
| 3,400,477 | 9/1968 | Brown . | |
| 3,675,274 | 7/1972 | Fried et al. | 24/7 |
| 3,831,301 | 8/1974 | Reynard . | |
| 3,847,325 | 11/1974 | Nasalski et al. . | |
| 3,893,252 | 7/1975 | Chase . | |
| 3,933,294 | 1/1976 | Meenan et al. | 40/359 |
| 3,994,088 | 11/1976 | Ohfuji . | |
| 4,082,875 | 4/1978 | Citron . | |
| 4,106,230 | 8/1978 | Martinez . | |
| 4,109,850 | 8/1978 | Meenan | 40/359 |
| 4,229,022 | 10/1980 | Grundell | 281/45 |
| 4,301,199 | 11/1981 | Pfanstiehl . | |
| 4,486,032 | 12/1984 | Leahy | 281/45 |

*Primary Examiner*—Paul A. Bell
*Assistant Examiner*—Paul M. Heyrana, Sr.
*Attorney, Agent, or Firm*—Burd, Bartz & Gutenkauf

[57] ABSTRACT

Clips for temporarily holding a memo or note on a surface. The clip comprises an elongated strip of semi-rigid resilient sheet material having a lip along one longitudinal edge and a longitudinal strip of adhesive parallel to and spaced from the lip. In the preferred form of the clip, the lip is upturned and the adhesive is applied to the opposite surface of the strip. The clips may be formed from plastic or paperboard sheet material. Where the clips are provided separately from the surface to which they are to be attached, a pressure-sensitive adhesive is preferably used, along with a peelable cover strip. The clips may be one- or two-sided. They may be provided in combination with file folders or file dividers. In some forms they may be formed integrally with the file folder or divider. In a preferred form, the clips are provided with a tension crease for enhanced holding power.

6 Claims, 11 Drawing Figures

FILE CLIPS

FIELD OF THE INVENTION

1. BACKGROUND OF THE INVENTION

This invention relates to clips affixed to or adapted to be affixed to the surfaces of file folders, file dividers, and the like. The function of the clips is to provide a method for holding loose note papers, memos, telephone call slips, and the like, for easy access. The clips are likewise adapted for use on bulletin boards, doors and walls, refrigerators and kitchen cabinet doors, car dashboards and sun visors, and the like, or almost any other surface to which it may be desired to temporarily affix a memo or note.

2. THE PRIOR ART

The wire or plastic paper clip is the standard method for temporarily securing note papers to a file folder. The use of paper clips presents some disadvantages. When files with paper clips are stored, the clips frequently catch on adjacent files, they become dislodged, they sometimes cause damage to papers within the file folders. The present invention is directed toward alleviating these inconveniences.

SUMMARY OF THE INVENTION

Broadly stated, the present invention is directed to clips for temporarily holding a memo or note on a surface. The clip comprises an elongated strip of semi-rigid resilient sheet material having a lip along one longitudinal edge and a longitudinal strip of adhesive parallel to and spaced from the lip. In the preferred form of the clip, and lip is upturned and the adhesive is applied to the opposite surface of the strip. The clips may be formed from plastic or paperboard sheet material. Where the clips are provided separately from the surface to which they are to be attached, a pressure sensitive adhesive is preferably used, along with a peelable cover strip. The clips may be one- or two-sided. They may be provided in combination with file folders or file dividers. In some forms they may be formed integrally with the file folder or divider. In a preferred form, the clips are provided with a tension crease for enhanced holding power.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
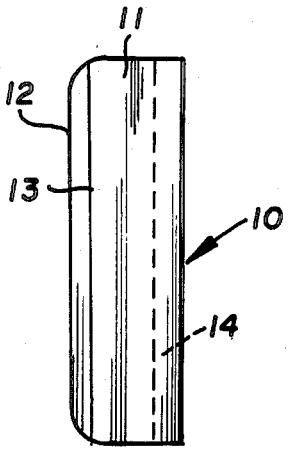
FIG. 1 is a plan view of one one-sided form of clip.
Figure 2:
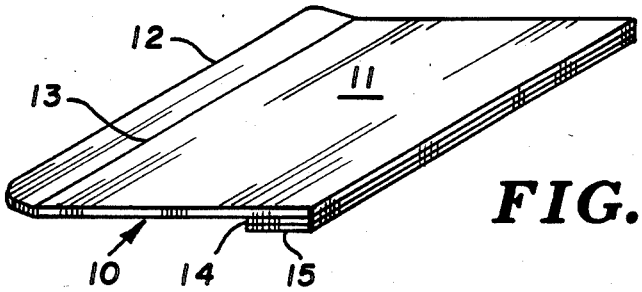
FIG. 2 is a perspective view thereof on an enlarged scale.

Referring now to FIGS. 1 and 2, there is shown one form of file clip, indicated generally at 10, according to the present invention. Clip 10 is comprised of an elongated generally rectangular strip 11 composed of thin, stiff, semi-rigid, resilient flat sheet material, such as synthetic resinous plastic or paperboard. The sheet material must be stiff enough to maintain its original formed configuration. It must be flexible enough to yield slightly to receive memos or other notes to be held by the clip. It must be resilient enough to exert holding force upon the notes held by the clip and to return to its original position when those notes are removed. Exemplary plastic materials include polystyrene, polyvinyl chloride, and the like. Exemplary paperboard material includes Manila stock such as that from which file folders are formed, postcard stock, and the like. Where the clip is formed from plastic, it may have a write-on surface.

Clip 10 preferably has a slightly upturned lip 12 along one longitudinal edge formed by folding sheet 11 along line 13 parallel to the edge of the strip. When the clip 10 is in place against a flat surface, the slightly upturned lip facilitates entry into the clip of a sheet of paper. The angle of deviation from the remainder of the strip is not critical but typically may be in the range of about 5 to 30 percent. Similarly, the width of the lip is not critical but typically is between about 1/16 and $\frac{1}{4}$ inch.

A longitudinal strip of adhesive 14 is disposed on the opposite side and opposite surface of strip 11 from upturned lip 12. For clips provided for application by the user, adhesive 14 is preferably a pressure-sensitive adhesive covered by an overlying peelable strip 15. However, moisture-sensitive adhesive may also be used. For factory assembly, conventional glues may be used. The adhesive strip 14 is applied along the edge of strip 11 opposite from the lip 12. The width of the adhesive strip 14 is not critical and depends somewhat upon the width of strip 11. At least about $\frac{1}{2}$ to 1 inch spacing should be maintained between the adhesive strip and lip 12 to provide an adequate holding area for the notes to be held by the clip.

The overall dimensions of the clip are not critical. In the exemplary form of clip 10 shown in FIG. 1, the length is about $2\frac{1}{2}$ inches, the width about $\frac{3}{4}$ inch, the width of lip 11 about $\frac{1}{8}$ inch, and the width of adhesive strip 14 about $\frac{1}{8}$ inch. The clip may be formed in long lengths since they may be readily cut with scissors to the desired length for use. Because of its considerable surface area, the clip lends itself readily for use as an advertising novelty with an appropriate message imprinted thereon.

Figure 3:
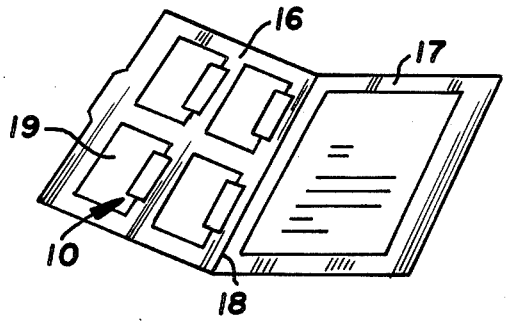
FIG. 3 is a perspective view of a file folder provided with several clips.
Figure 4:
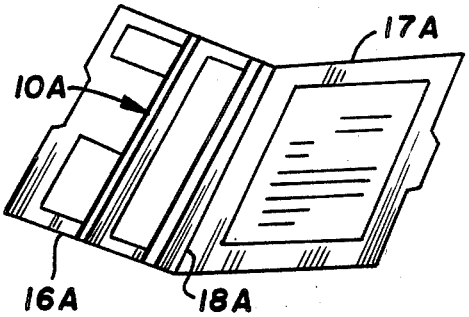
FIG. 4 is a similar perspective view showing a file folder with a different configuration of clips.

FIGS. 3 and 4 show the typical applications of the file clips according to the present invention. FIG. 3 shows a typical file folder composed of a front cover 16 and back cover 17 joined along a fold line 18. A plurality of clips 10 are adhesively secured to the inside front cover 16. The clips 10 extend longitudinally parallel to the fold line 18 and disposed with the adhesive strip closest to the fold line such that the open side of each clip faces toward the free longitudinal edge of the front folder cover. In this form, the clips are totally enclosed by the folder such that they will not catch on adjacent folders. Being fixed in place and thin, they will not damage papers held in the folder. Memos 19 or similar notes are easily slipped into the clip by pushing the edge of the note against lip 12 in one smooth motion. The notes are held by the force of the entire body of the clip acting as a pressurized and frictional surface. When the folder is stored in its normal vertical position, the force of gravity assists the clip in holding the paper notes. FIG. 4 is similar. The file folder composed of front cover 16A and back cover 17A joined along fold line 18A is provided with a pair of elongated parallel disposed clips 10A. Apart from length, clips 10A are identical in all material respects to clips 10 of FIG. 3.

Figure 5:
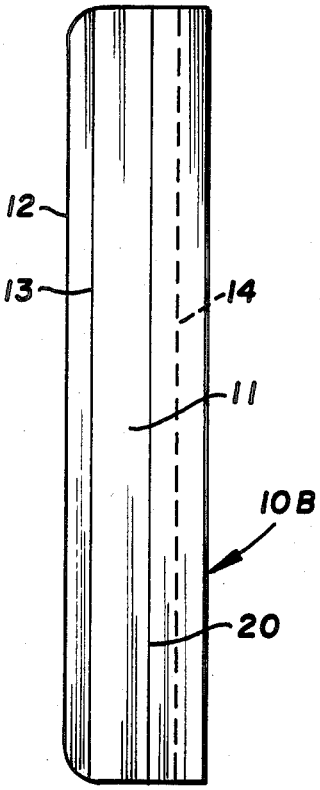
FIG. 5 is a plan view of a modified form of one-sided clip having a tension crease.
Figure 6:
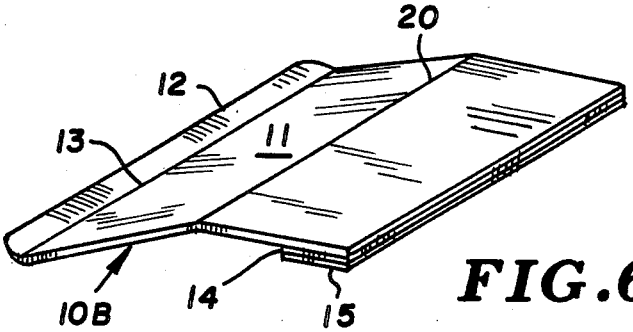
FIG. 6 is a perspective view thereof of an enlarged scale.

Referring now to FIGS. 5 and 6, there is shown a modified form of clip 10B. Although shown as having greater length, clip 10B includes all of the material features and elements of clip 10 already described in detail. In addition, clip 10B is provided with a longitudinal tension crease or fold line 20. Tension crease 20 is formed in strip 11 between lip fold line 13 and adhesive strip 14 and parallel thereto. The tension crease in folded inwardly toward the adhesive side of the strip.

When the clip is adhesively secured to a flat surface, the tension crease flattens out and the strip becomes tensioned. As a result, any memos or notes are held in the clip more securely due to the greater degree of pressure exerted upon it. The note paper can be easily inserted with very low entry pressure but encounters increasing resistance as it makes contact with more of the area of the clip. The angle of the tension crease dictates the degree of increased tension, the greater the angle, the greater the tension. Although not critical, typically the angle of deviation from horizontal is between about 5° to 15°. This modified form of clip is used in an identical manner to those already described.

Figure 7:
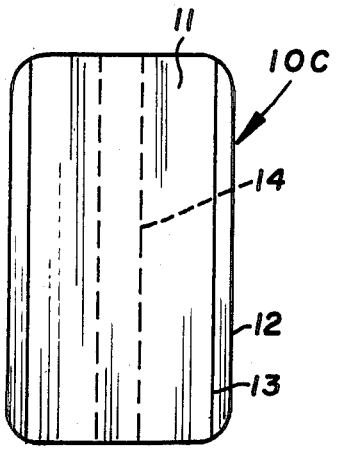
FIG. 7 is a plan view of one form of two-sided clip.
Figure 8:
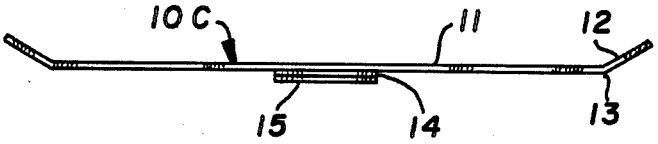
FIG. 8 is an end view thereof on an enlarged scale.

Referring now to FIGS. 7 and 8, there is shown a double or two-sided clip 10C. The structure of clip 10C is generally similar to that of clip 10 doubled as if two clips 10 were joined in mirror image. Thus, it is comprised of an elongated strip 11 of generally rectangular configuration formed from semi-rigid sheet material. It has an upturned lip 12 on each opposite longitudinal side formed along fold line 13 and both extending in the same direction, and a longitudinal strip of adhesive 14 extending the length of the strip and spaced from and parallel to the side edges thereof. Where adhesive strip 14 is pressure-sensitive, it is provided with a cover strip 15. This form of clip functions in all material respects similar to those already described except that memos or notes may be inserted on either longitudinal side of the clip.

Figure 10:
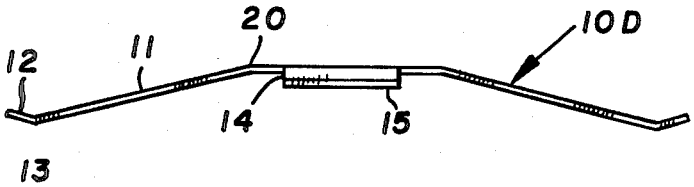
FIG. 10 is an end view thereof on an enlarged scale.
Figure 11:
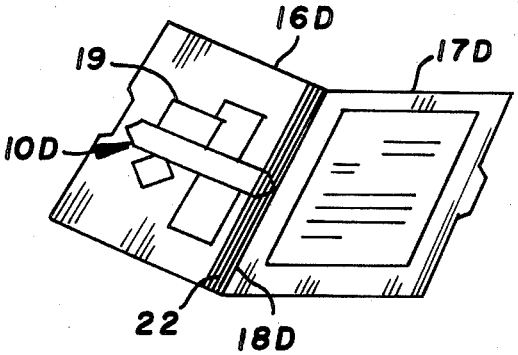
FIG. 11 is a perspective view of a file folder with the clip of FIG. 9.
Figure 9:
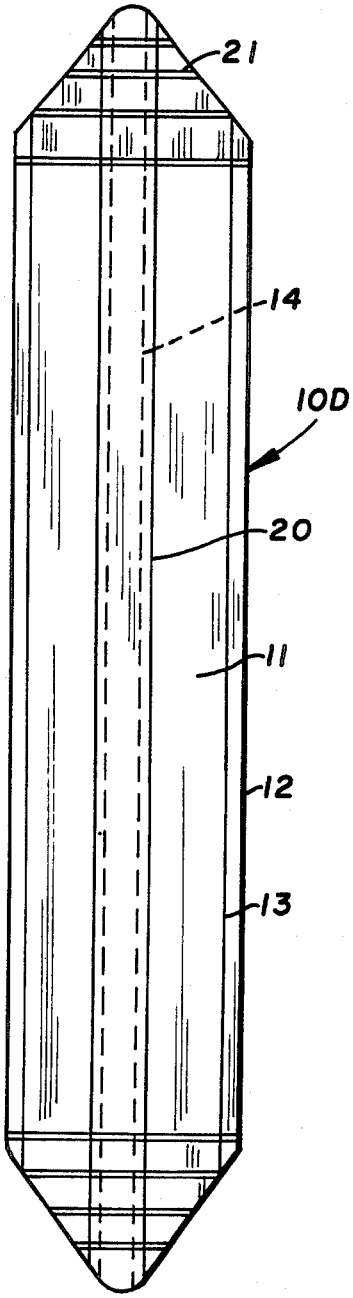
FIG. 9 is a plan view of another form of two-sided clip provided with tension creases.

FIGS. 9 and 10 show another form of clip 10D similar in structure to clip 10C except for the addition of a pair of longitudinal tension folds or creases 20. When clip 10D is formed from Manila or similar paperboard, it preferably is provided with a plurality of fold lines or creases 21 spaced to coincide with expansion fold lines or creases 22 formed in many file folders such as file folder front cover 16D which is connected to back cover 17D along fold line 18D, as shown in FIG. 11. Thus, when the clip 10D is secured to the file folder a shown, as th contents of the file folder become thicker, the folder may expand in the usual manner without interference from the clip. To minimize the resistance to expansion of the file folder caused by the clip 10D, the sides of the clip are desirably tapered inwardly as shown. This also insures progressive expansion of the file folder from the fold line outwardly.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A clip for temporarily holding a memo or note on a surface, said clip comprising:

(A) an elongated strip of semi-rigid resilient sheet material, (B) an upturned lip disposed along both opposite longitudinal edges of the sheet material, said lips both being upturned in one direction, (C) a longitudinal strip of adhesive disposed on the opposite surface of the sheet material from the direction of said upturned lips, said adhesive strip parallel to said lips and spaced therefrom approximately midway between said lips.

2. A clip according to claim 1 wherein a pair of tension creases are formed in the surface of the sheet material, said tension creases being:

(A) co-extensive with the length of the sheet material, (B) spaced from said adhesive strip on opposite sides thereof and parallel thereto, and (C) between the adhesive strip and lips.

3. A clip according to claim 2 wherein:

(A) both ends of said sheet material are tapered from a narrow midsection toward the opposite longitudinal edges, and (B) both ends of said sheet material are provided with spaced apart parallel expansion creases.

4. A clip according to claim 1 wherein:

(A) said adhesive strip is a pressure-sensitive adhesive, and (B) a removable lightly adherent peelable cover strip is applied over said pressure-sensitive adhesive.

5. A clip for temporarily holding a memo or note on a surface, clip comprising:

(A) an elongated strip of semi-rigid resilient sheet material, (B) a lip along at least one longitudinal edge of said strip, (C) a longitudinal strip of adhesive spaced from said lip, and (D) a tension crease formed in the surface of the sheet material, the tension crease being:

(1) co-extensive with the length of the sheet material, (2) spaced from said adhesive strip and parallel thereto, and (3) between the adhesive strip and lip.

6. A clip according to claim 5 wherein:

(A) said adhesive strip is a pressure-sensitive adhesive, and (B) a removable lightly adherent peelable cover strip is applied over said pressure sensitive adhesive.

* * * * *